United States Patent [19]

Hermanns

[11] 4,093,135

[45] June 6, 1978

[54] DEVICE FOR CONTROLLING A RESERVE WINDING WHEN WINDING THREAD ON A SPOOL OR CORE

[75] Inventor: Peter Hermanns, Stommeln, Germany

[73] Assignee: FMN Schuster & Co., Hurth-Efferen, Germany

[21] Appl. No.: 652,337

[22] Filed: Jan. 26, 1976

[30] Foreign Application Priority Data

Jan. 28, 1975 Germany ..... 2503299

[51] Int. Cl.[2] ..... B65H 54/02; B65H 54/34

[52] U.S. Cl. ..... 242/18 PW; 242/165

[58] Field of Search ..... 242/18 PW, 165; 57/34 TT

[56] References Cited

U.S. PATENT DOCUMENTS

| | | | |
|---|---|---|---|
| 1,477,162 | 12/1923 | Andrew | 242/165 |
| 3,814,341 | 6/1974 | Dickson et al. | 242/18 PW |
| 3,823,884 | 7/1974 | Sartori | 242/18 PW |
| 3,858,816 | 1/1975 | Corbiere | 242/18 PW |

*Primary Examiner*—Stanley H. Gilreath

*Attorney, Agent, or Firm*—Lowe, King, Price & Markva

[57] ABSTRACT

A device effects the method of controlling a reserve winding during winding of a thread onto a spool or core, in which the thread is fed to the spool by a delivery mechanism via a traversing device. A reserve winding zone is defined adjacent the end of the spool. The thread is applied to the spool at an intermediate point within the reserve winding zone. Then, the thread is moved outwardly along the spool toward the end thereof and subsequently moved inwardly in the direction of the thread package to be formed.

The device comprises means for effecting the method of the invention. A specific embodiment includes a stationary limiting member and a pivotally mounted thread guide control member which moves in cooperation with the stationary member to effect the desired method.

18 Claims, 8 Drawing Figures

DEVICE FOR CONTROLLING A RESERVE WINDING WHEN WINDING THREAD ON A SPOOL OR CORE

BACKGROUND OF THE INVENTION

This invention relates to a method of and a device for controlling a reserve winding when winding thread onto a spool or core. The thread is fed to a spool from a delivery mechanism via a traversing device and the start or end of the thread is fixed to the spool.

It is known to have a reserve winding on a spool to make the thread end located on the spool available to hand at any time during the unwinding of the thread package. This enables continuous manipulation of many thread packages. That is, the thread end of one package is connected, during the unwinding of the same, with the thread beginning of the next package. The spools may be driven either by a friction roller or by a motor as in the case of precision winding machines.

A thread reserve winding can be wound in various ways. In one prior art method, thread is wound into a thread reserve winding in such a way that the thread is disposed in parallel or roughly parallel onto the spool. The thread is wound onto the spool at a length of about 8 to 10 mm and having about 7 to 12 windings. Such a reserve winding has the advantage that the thread end is easily released from the spool without damage and the following package can be easily connected to the thread. As the result of the parallel position of the thread in the reserve winding, however, the thread end is not fixed to the spool. Consequently, the reserve winding may accidentally slip and drop from the spool. For this reason, the free hanging thread must be fixed to the end of the spool. This is usually fixed by gluing it to the spool. This type of fixture is unreliable, complicated and involves an additional working operation.

In another prior art method, the reserve winding is produced more or less as a flange of thread. The thread end is wound on top of itself in an uncontrolled or random manner. The thread end is fixed and secured by superimposed thread windings. Thus, there is no additional fixing of the thread end. However, in order to release it, the thread end must be withdrawn below the thread flange out of irregularly placed thread windings. The position of the thread end below the reserve winding is left to chance during its irregular construction. Consequently, when the thread end is withdrawn, there is a risk that tangles will result and that the thread filaments may be stretched, torn or otherwise damaged. In particular, so-called capillary breakages are produced in the threads so that the thread has no longer the desired strength in the relevant part.

PURPOSE OF THE INVENTION

The primary object of the invention is to automatically control the winding of the reserve winding during the winding of a thread onto a spool or core.

Another object of the invention is to provide a method of winding a reserve winding by fixing the thread end and having it come beneath the reserve winding with the thread windings of the reserve winding being laid in a controlled manner.

A further object of the invention is to produce an automatically controlled reserve winding wherein upon withdrawal of the reserve winding thus formed that the last windings lying closest to the thread package will remain undamaged.

SUMMARY OF THE INVENTION

The method of the invention comprises the defining of a reserve winding zone adjacent the end of the spool. The thread is applied to the spool at an intermediate point in the reserve winding zone and thereafter moved in an outward direction toward the end of the spool. Then, the thread is moved in a direction toward the thread roll or package being formed. The thread is advantageously applied roughly in the middle of the reserve winding zone.

The procedure of starting the thread for the formation of a reserve winding is effected by its insertion onto the spool by an entrainment device. This device may consist of an edge notch of a thread catch or ring located on the spool into which the thread is inserted by means of a thread suction pistol. The axial movement of the thread along the spool for forming the thread package is effected conventionally by a thread guide device operating along the base of a thread triangle as is well known in the prior art.

The device of this invention is disposed adjacent the spool end and includes a means for applying the thread to a spool at an intermediate point within the reserve winding zone defined adjacent the end of the spool. Means is provided for moving the thread in a to-and-fro movement first in an outward axial direction toward the end of the spool and then in an inward axial direction away from the end of the spool toward the spool package being formed. Means is also provided for maintaining the speed of the thread at a predetermined amount during to-and-fro movement within the reserve winding zone.

In a specific embodiment of the invention, the device includes a pivotally mounted thread guide control means disposed adjacent a stationary limiting means. The pivotally mounted thread guide control means includes a cam follower means spring-biased against a cam. The speed of the cam in terms of its revolutions per minute is maintained at a predetermined ratio with respect to the speed of the spool thereby determining the number of thread windings.

The pivotally mounted thread guide control means is permanently or continuously moved back and forth across the reserve winding zone. The thread end is held by the suction pistol and can be fed to the pivotal thread guide or control means during the phase in which the thread guide control means is moving outwardly in a direction toward the end of the spool. Thus, a few controlled thread windings are initially laid from an intermediate point of the reserve winding zone. Then, as the thread guide control means pivotally returns in a direction toward the center of the spool, the windings are likewise laid in the direction of the spool center. Consequently, at the end of the pivotal movement of the thread guide, a traversing device takes over the thread in order to form a thread package in the conventional way. The device of this invention thus automatically secures the thread end underneath a few thread windings. The pivotally mounted thread guide control means insures an orderly positioning of the thread windings so that the withdrawal of the thread end from the reserve winding zone is faultless.

Another feature of the invention is directed to the mechanism for feeding the thread to a movably disposed thread guide contact means which is moving in an outward direction along the length of the spool. The thread fedding mechanism effects feeding of the thread to the thread moving means only at a position from which the thread is being mvoed in the outward axial direction. While the pivotally mounted thread guide control means executes a continuous to-and-fro movement, the movement of the thread being fed toward the thread guide contact means is effected only in the outward movement phase of the thread guide contact means.

The thread feeding means incorporates the use of a movably disposed nose which operates in conjunction with the movably disposed thread guide contact means. The nose serves as a catch piece for the thread and interacts with a further limiting member for the purpose of holding a thread up until the precise moment it is to be fed to the outwardly moving thread guide means. The limiting member is stationary and has a thread guide surface including a recess. The thread is held in this recess until the pivotal thread guide control member undertakes the outward axial movement. The nose portion and the recess in the limiting means are disposed in front or ahead of the frontal end of the spool.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

BRIEF DESCRIPTION OF SPECIFIC EMBODIMENTS

Figure 1:
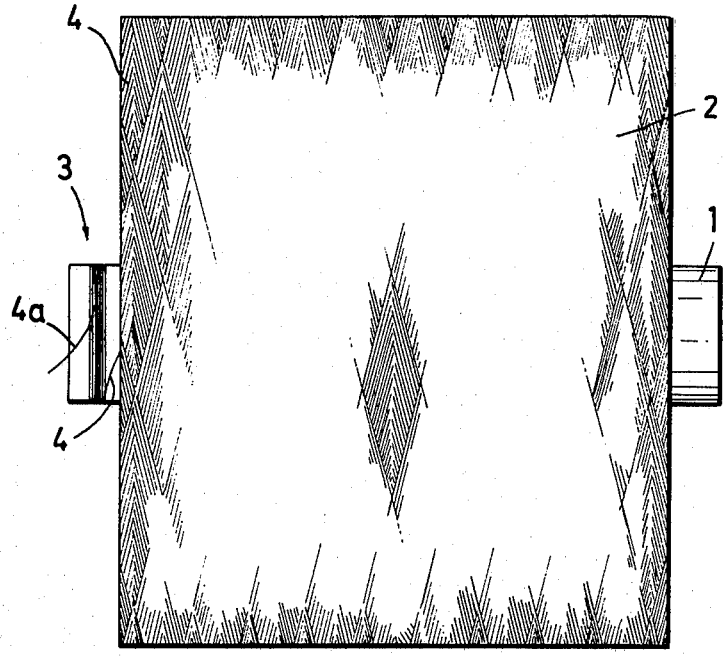
FIG. 1 is a side elevational view of a spool carrying a thread package and a reserve winding in accordance with the present invention.
Figure 2:
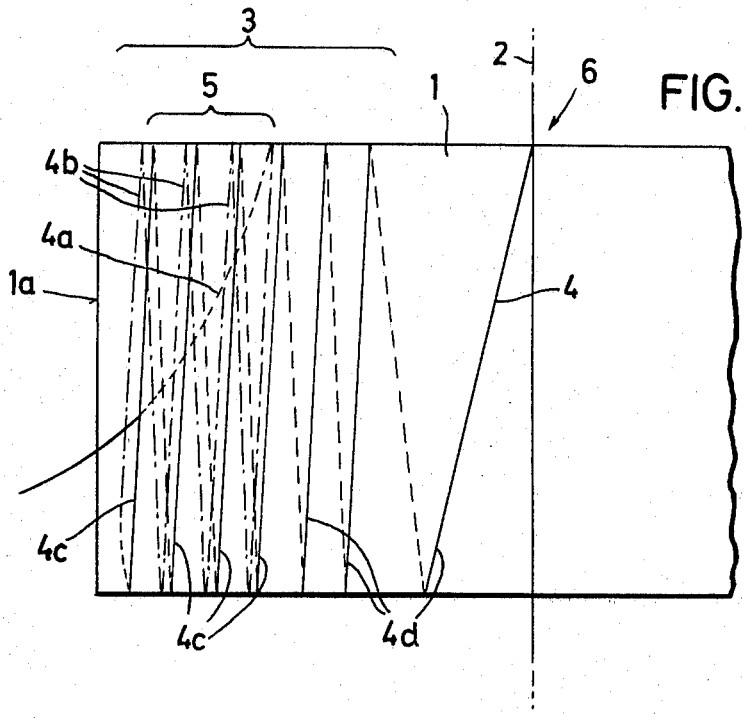
FIG. 2 is a fragmentary view of the reserve winding shown in FIG. 1 showing the principle of application of the thread during formation of said reserve winding.

More specifically, referring to the drawings, the method and apparatus of this invention effects the build-up of a reserve winding 3 on a spool or core 1 with a thread package 2. As shown in FIGS. 1 and 2, the end 4*a* of thread 4 runs beneath a winding 5 at one end of the spool 1. The winding 5 begins roughly in the middle of the zone of the reserve winding 3 and extends outwardly with the thread windings 4*b*. That is, the winding 5 extends outwardly with the thread windings 4*b*. That is, the winding 5 extends in the direction toward the front end 1*a* of spool 1. The direction of movement of the thread winding 5 then changes to the opposite direction with the thread windings 4*c* extending inwardly in the direction toward the middle of the spool 1. Thread 4 is taken over by the conventional thread guide device of a traversing device roughly at location 6. The thread guide device then operates on the thread 4 in a conventional way thereby forming the thread package 2.

During this build-up of the reserve winding 3, both thread windings 4*b* in the region of winding 5 of reserve winding 3 and the thread windings 4*c* thereabove lie fully ordered with a slight inclination. Thread end 4*a* projects a predetermined distance outwardly and extends to the spool end 1*a*. Thread 4*a* is fixed and secured by thread windings 4*b* and by part of the thread windings 4*c*. The thread windings 4*d* remain reliably in position without superimposed threads outside the winding region or zone 5.

Figure 3:
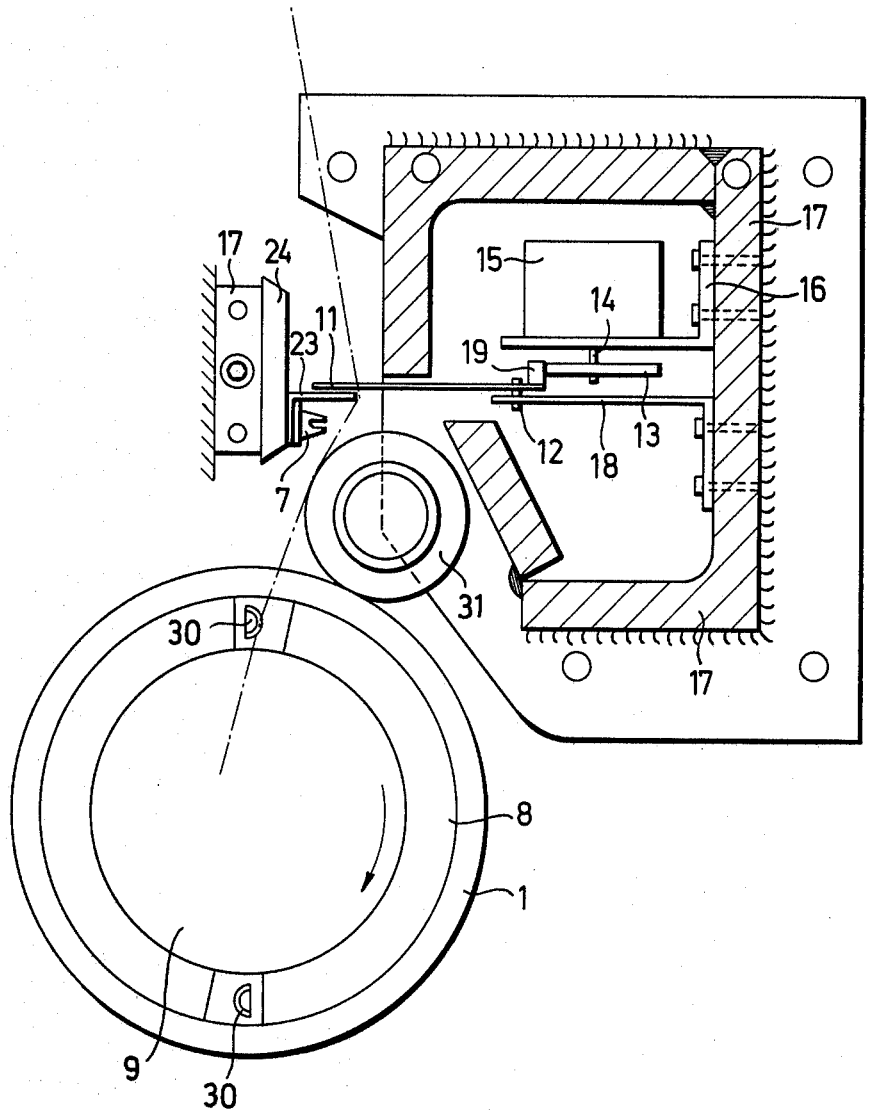
FIG. 3 is an end view partially in section showing a thread winding machine having a pivotal thread guide control means.

During withdrawal, thread windings 4*b* are first drawn off spool 1. Thread windings 4*c* which extend in the direction of package 2 are then withdrawn. This procedure is faultless and in accordance with the sequence of the thread windings. After withdrawal, the thread windings 4*d* are in a perfect, undamaged state. The portion of the released thread of the reserve winding, which is not required for knotting to the thread end of the adjacent thread roll, can be precisely cut off. The zone length of the reserve winding 3 can be 8 to 10 mm with from 6 to 15 thread windings. About 4 to 5 thread windings 4*d* generally are sufficient. All the thread windings in the reserve winding 3 are wound approximately parallel onto the end of the spool during a to-and-fro movement. Thread windings 4*b*, 4*c* and 4*d* exist in an ordered manner. First, the thread windings 4*b* lead outwardly and parallel on the spool to one hand. Then, the subsequent thread windings 4*c* run in the opposite direction and roughly parallel to the other end. Spike 8, designed as an expanding spike, carries spool 1 on which thread roll 2 is produced. This is a known structural configuration. Spool 1 may be driven by a motor 9 shown schematically incorporated with hollow spike 8. The spike 8 carrying spool 1 and the thread windings are pivotal along a guide in accordance with the increasing diameter of the thread roll in a known manner. As shown in FIG. 3, a pressure roller 31 is in contact with spool 1 for effecting rotation thereof.

A thread guide control means, generally designated 10, is used to guide the thread 4 during formation of the reserve winding 3. Thread contact portion 11 is mounted to pivot around shaft 12. Cam 13, rotatably mounted on shaft 14 and driven by an electric motor 15, effects pivoting of the thread contact portion 11. Motor 15 is located on bracket 16 which is attached to the machine frame 17. A further bracket 18 carries shaft 12 and is also attached to machine frame 17. A follower arm 19 is connected with the thread contact portion 11 and is pressed against the periphery of the cam 13 under the bias of a spring 20.

A stationary limiting device, generally designated 21, is associated with the thread guide control means 10 for forming the reserve winding. Limiting device 21 has cooperating guide elements for the thread 4. Interaction of the guide elements is such that the thread 4 can only come into contact with the thread guide contact portion 11 when the latter, during its pivoting movement under control of rotating cam 13, is in the phase of its motion in the direction toward the frontal end 1*a* of spool 1. Nose 22 of thread guide control means 10 is used to effect the desired movement of thread 4. Moreover, a stationary limiting member 23 for the thread 4 is mounted on a holder 24 which is rigidly connected to the machine frame 17.

The stationary limiting member 23 has a recess 25 which has a contour corresponding to the shape of nose 22. Limiting member 23 serves to accommodate the thread 4 in a predetermined position of the thread guide contact portion 11 together with nose 22. Limiting member 23 also has a straight thread guide portion 26 extending over a predetermined length toward the center of spool 1 away from the recess 25. The limiting member 23 includes a further guide edge 27 extending over a predetermined length away from the center of the spool 1 and from the edge of recess 25. Nose 22 and guide edge 27 are arranged with respect to each other in such a way that thread 4 comes to lie in front of the end 1*a* of spool 1 at the beginning of its insertion into the thread guide control means 10.

In operation, the winding head of spool 1 which is fixed on expanding spike 8, is brought to full speed by motor 9. The thread 4 to be wound is passed by known means of a suction pistol, or the like, over the overflow elements. The thread end 4*a* is brought to the front end of the expanding spike 8 so that the thread 4 is grasped by a thread catch ring 30 located on the front end of spike 8. See FIG. 3.

Figure 4:
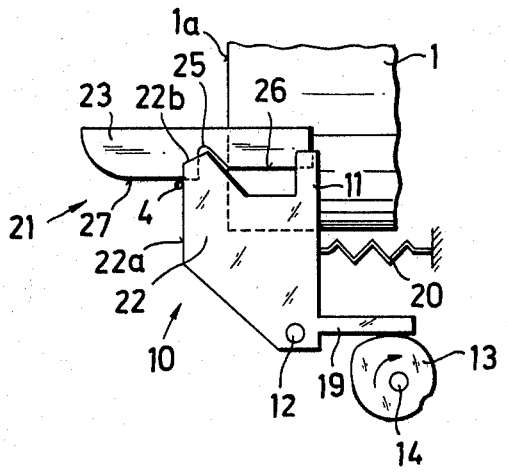
FIGS. 4 to 8 are plan views showing five different phases of movement of a device for controlling the reserve winding during winding of a thread onto a spool.

Referring to FIG. 4, thread 4 is guided level in the angle between the edge 22*a* of nose 22 and the guide edge 27 of the limiting member 23. As a result of this guidance, thread 4 attempts to run toward the center of the spool length 1. Therefore, thread 4 as disposed in the angle between edges 22*a* and 27 tends to lie on these edges and be guided thereby.

Figure 5:
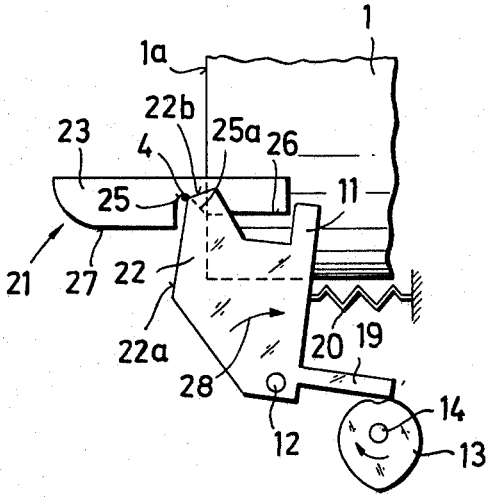
Figure 6:
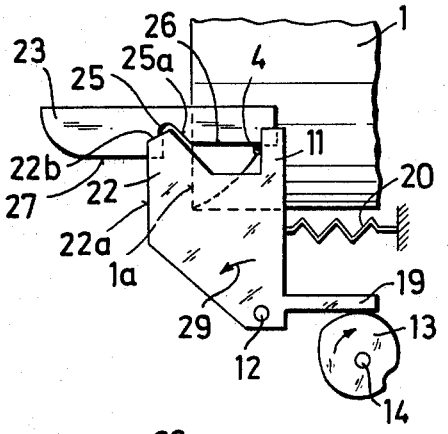

The thread guide control means 10 including thread guide contact portion 11 and nose 22 is continuously pivoted to-and-fro about shaft 12 by the cam 13. During the pivoting movement of the thread guide contact section 11 in the direction of arrow 28, nose 22 passes beyond the recess 25. Consequently, thread 4 passes in the direction of the center of the spool 1 into the recess 25 as shown in FIG. 5. Thread 4 effects this movement as the result of the traction resulting from the thread triangle which is well known in the prior art. Recess 25 thereby forms a lock for holding thread 4 until nose 22 with its guide edge 22*b* is clear of the guide edge 25*a* of the recess 25. The clearing of the guide edge 25*a* is effected upon movement of the thread guide control means 10 outwardly in the direction of arrow 29. This opens up a path of movement for thread 4 along the guide edge 25*a* and straight edge portion 26 of the limiting member 23. Thread 4 now moves therealong and contacts the thread guide contact portion 11 as shown in FIG. 6. While the thread guide control means 10 is in the phase of this outwardly directional motion, the thread windings 4*b* begin to be formed.

The thread lock formed by recess 25 and nose edge 22*b* fulfill the purpose of preventing thread 4 from coming into contact with the thread guide contact portion 11 in an unfavorable position. The thread lock only releases thread 4 for contact with the contact portion 11 when the latter is between the ends of its to-and-fro movement. This advantageously takes place in the middle of this movement and while movement is outward according to the arrow 29.

It is immaterial at which stage of the back-and-forth pivoting movements of the contact portion 11 that the thread end is brought onto the spool to form the reserve winding 3 connecting with the thread package 2, because the contact portion 11 is moved continuously back-and-forth or to-and-fro during the procedure of the formation of the reserve winding 3. As a result of the interposed thread lock, thread 4 can only come into contact with the contact portion 11 when the latter is moving in an outward direction. This produces the thread windings 4*b* in an ordered fashion within the reserve winding zone 3. The thread lock is formed by recess 25 and edge 22*b* and serves to delay thread 4 being applied to the device until the contact portion 11 is moving from the middle of the length of the reserve winding zone 3 and is pivoting outwardly.

Figure 7:
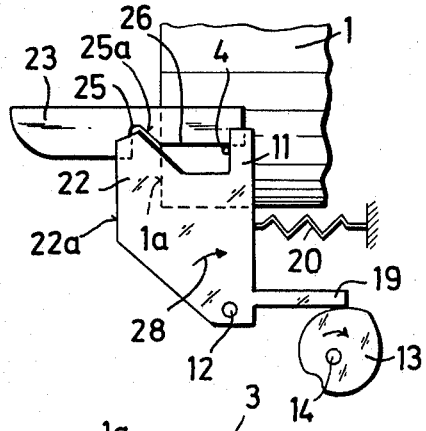
Figure 8:
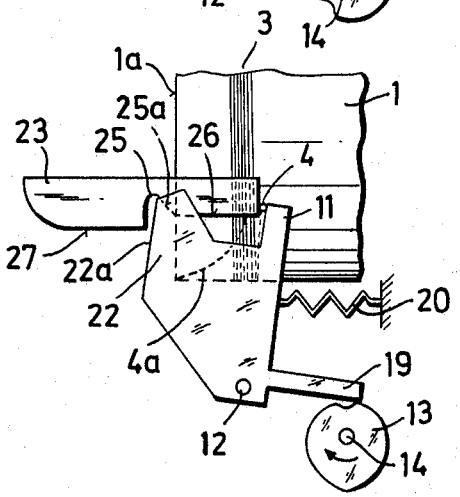

The contact portion 11 is shown in its outward end position in FIG. 7. This outward end position is reached as a result of the position of cam 13. Thread guide contact portion 11 then begins to pivot toward the center of the spool 1 in the direction of arrow 28 after cam 13 has passed its highest point. Consequently, thread 4 is laid on the rotating spool 1 in orderly, parallel windings 4*c*. Thread contact portion 11 reaches its extreme innermost pivotal position when arm 19 engages the lowest point of cam 13 as shown in FIG. 8. In this extreme innermost position, thread contact portion 11 moves away from the guide edge 26 of limiting member 23 thereby releasing thread 4. The reserve winding 3 is now complete. Thread 4 is drawn further toward the center of the spool 1 by the lateral componenent of force of the thread triangle until the traversing device 7 takes over thread 4 to form the thread package 2. The traversing device 7 is designed as a self-threading mechanism. Now the actual spool winding process begins and thread package 2 is produced.

The thread reserve winding of this invention is intended to consist of about 10 to 15 windings. Therefore, the speed and revolutions of the cam 13 is coordinated to the speed in revolutions per minute of spool 1. This means that there must be 10 to 15 revolutions of spool 1 to each to-and-fro movement of the thread guide device 10.

In this specific embodiment, the thread guide control member 10 is a flat piece having a thread contact portion 11, nose 22 and cam follower arm 19. The control member 10 in this specific embodiment is a stamped sheet metal component. The limiting member 23 is also formed as a flat piece and may be angular in cross-section so that it may be attached by one leg to the machine frame. See FIG. 3. Both flat pieces lie close one above the other. The distances between the opposed surfaces of these flat pieces is only a few tenths of a millemeter. The thread contact portion 11 and nose 22 can alternatively be produced in any other suitable manner. The pivotal movements of the thread contact portion 11 are coordinated to those of the nose 22 by the shape of cam 13. A selection of a heart shape has proved to be the most advantageous for the design of cam 13.

ADVANTAGES OF THE INVENTION

In accordance with this invention, the thread end comes to lie under a few thread windings and is secured thereby. The thread windings are disposed in a controlled manner. That is, they lie parallel or roughly parallel to one another. A further advantage of the invention is that the portion of the reserve winding adjacent the thread package is free of superimposed threads. Thus, this portion is not exposed to the risk of damage during withdrawal of the reserve winding. In other words, the reserve winding is sub-divided through the use of the device for effecting the method of the invention. The outer portion of the windings of the reserve winding can be cut off so that it can be immediately tied to the thread of the next thread package with a portion of the reserve winding which is not subject to the risk of damage on withdrawal. Further advantage is that in the controlled formation of the reserve winding, only a few thread windings are necessary. Finally, operational interruptions during the transmission from one thread package to another are considerably reduced during an unwinding process by using thread packages formed with reserve windings resulting from the present invention.

While the method and device for controlling a reserve winding when winding thread onto a spool or core has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A device for controlling a reserve winding during winding of a thread onto a spool or core, in which the thread is fed to the spool by a delivery mechanism via a traversing device, said device comprising:
   a. means for applying an end of the thread to the spool at an intermediate point approximately midway of the length of a reserve winding zone defined adjacent the end of the spool,
   b. means for moving the thread in a to-and-fro movement first in an outward axial direction toward the end of the spool to fix said thread end by a plurality of crossing thread windings forming a first layer of windings and then in an inward axial direction away from the end of the spool to form a plurality of reserve windings over the first layer of windings,
   c. means for maintaining the speed of the to-and-fro movement of the thread within the reserve winding zone at a predetermined amount,
   d. said moving means includes a stationary member having a straight edge portion and a movably disposed thread guide contact means, and
   e. said thread guide contact means being effective to cause the thread to move to-and-fro along the straight edge portion.

2. A device as defined in claim 1 wherein
   said speed maintaining means includes a rotatably mounted cam means and a cam follower means,
   said cam follower means being connected to the thread guide contact means to effect movement thereof.

3. A device for controlling a reserve winding during winding of a thread onto a spool or core, in which the thread is fed to the spool by a delivery mechanism via a traversing device, said device comprising:
   a. means for applying an end of the thread to the spool at an intermediate point approximately midway of the length of a reserve winding zone defined adjacent the end of the spool,
   b. means for moving the thread in a to-and-fro movement first in an outward axial direction toward the end of the spool to fix said thread end by a plurality of crossing thread windings forming a first layer of windings and then in an inward axial direction away from the end of the spool to form a plurality of reserve windings over the first layer of windings,
   c. means for maintaining the speed of the to-and-fro movement of the thread within the reserve winding zone at a predetermined amount,
   d. said moving means includes a stationary member having a straight edge portion and a pivotally disposed thread guide contact means,
   e. said speed maintaining means includes a cam means and a cam follower means, and
   f. said cam follower means being connected to the thread guide contact means to effect pivotal movement thereof in response to movement of the cam means.

4. A device as defined in claim 3 wherein
   the cam means comprises a rotatably mounted cam member.

5. A device as defined in claim 4 wherein
   the cam follower means is spring biased against the cam means.

6. A device for controlling a reserve winding during winding of a thread onto a spool or core, in which the thread is fed to the spool by a delivery mechanism via a traversing device, said device comprising:
   a. means for applying an end of the thread to the spool at an intermediate point approximately midway of the length of a reserve winding zone define adjacent the end of the spool,
   b. means for moving the thread in a to-and-fro movement first in an outward axial direction toward the end of the spool to fix said thread end by a plurality of crossing thread windings forming a first layer of windings and then in an inward axial direction away from the end of the spool to form a plurality of reserve windings over the first layer of first layer of windings,
   c. means for maintaining the speed of the to-and-fro movement of the thread within the reserve winding zone at a predetermined amount,
   d. the thread applying means includes means for feeding the thread to the thread moving means while the thread moving means is moving in said outward axial direction,
   e. said thread feeding means includes a stationary limiting means and a movably disposed nose means,
   f. said nose means being effective to catch the thread and maintain hold thereof in cooperation with the stationary limiting means.

7. A device as defined in claim 6 wherein the limiting means includes a recess and the nose means is connected to the thread moving means and moves back and forth past the recess.

8. A device as defined in claim 7 wherein
   the nose recess and nose means are located in front of said end of the spool.

9. A device for controlling a reverse winding during winding of a thread onto a spool or core, in which the thread is fed to a spool by a delivery mechanism via a traversing device, said device comprising:
   a. a stationary limiting means and a pivotally mounted thread guide control means,
   b. said stationary limiting means including a straight edge portion and a recess,
   c. said thread guide control means including a thread guide contact portion, a nose portion and a cam follower means,
   d. said cam follower means being spring-biased against a rotatably mounted cam means to effect movement of said thread guide contact means along said straight edge portion and movement of the nose means with respect to the recess,
   e. said thread guide contact portion being effective to cause the thread to move to-and-fro along the straight edge portion.
   f. said nose means being effective to catch the thread and maintain hold thereof in cooperation with the recess until release of the thread to said thread guide contact portion moving along said straight edge portion.

10. A device as defined in claim 9 wherein said stationary limiting means comprises a first flat stamped sheet metal piece, said thread guide control means includes a second flat stamped sheet metal piece and said flat pieces are disposed one above the other in close proximity therewith.

11. A device for controlling a reserve winding during winding of a thread onto a spool or core, in which the thread is fed to the spool by a delivery mechanism via a traversing device, said device comprising:

a. means for applying the thread to the spool at an intermediate point within a reserve winding zone defined adjacent the end of the spool, b. means for moving the thread in a to-and-fro movement first in an outward axial direction toward the end of the spool and then in an inward axial direction away from the end of the spool, and c. means for maintaining the speed of the to-and-fro movement of the thread within the reserve winding zone at a predetermined amount, d. said moving means includes a stationary member having a straight edge portion and a movably disposed thread guide contact means, e. said thread guide contact means being effective to cause the thread to move to-and-fro along the straight edge portion.

12. A device as defined in claim 11 wherein said speed maintaining means includes a rotatably mounted cam means and a cam follower means, said cam follower means being connected to the thread guide contact means to effect movement thereof.

13. A device for controlling a reserve winding during winding of a thread onto a spool or core, in which the thread is fed to the spool by a delivery mechanism via a traversing device, said device comprising:

a. means for applying the thread to the spool at an intermediate point within a reserve winding zone defined adjacent the end of the spool, b. means for moving the thread in a to-and-fro movement first in an outward axial direction toward the end of the spool and then in an inward axial direction away from the end of the spool, and c. means for maintaining the speed of the to-and-fro movement of the thread within the reserve winding zone at a predetermined amount, d. said moving means includes a stationary member having a straight edge portion and a pivotally disposed thread guide contact means, e. said speed maintaining means includes a cam means and a cam follower means, f. said cam follower means being connected to the thread guide contact means to effect pivotal movement thereof in response to movement of the cam means.

14. A device as defined in claim 13 wherein the cam means comprises a rotatably mounted cam member.

15. A device as defined in claim 14 wherein the cam follower means is spring biased against the cam means.

16. A device for controlling a reserve winding during winding of a thread onto a spool or core, in which the thread is fed to the spool by a delivery mechanism via a traversing device, said device comprising:

a. means for applying the thread to the spool at an intermediate point within a reserve winding zone defined adjacent the end of the spool, b. means for moving the thread in a to-and-fro movement first in an outward axial direction toward the end of the spool to fix said thread end by about 4 to 5 thread windings forming a lowermost layer of windings and then in an inward axial direction away from the end of the spool, and c. means for maintaining the speed of the to-and-fro movement of the thread within the reserve winding zone at a predetermined amount, d. the thread applying means includes means for feeding the thread to the thread moving means while the thread moving means is moving in said outward axial direction, e. said thread feeding means includes a stationary limiting means and a movably disposed nose means, f. said nose means being effective to catch the thread and maintain hold thereof in cooperation with the stationary limiting means.

17. A device as defined in claim 16 wherein the limiting means includes a recess and the nose means is connected to the thread moving means and moves back and forth past the recess.

18. A device as defined in claim 17 wherein the nose recess and nose means are located in front of said end of the spool.

* * * * *